US008262264B2

(12) United States Patent
Cooper

(10) Patent No.: US 8,262,264 B2
(45) **Date of Patent: *Sep. 11, 2012**

(54) INTERLOCKING SYSTEM FOR HANGING DECORATIVE LIGHTS AND FIXTURES

(76) Inventor: James Michael Cooper, Layton, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/315,599

(22) Filed: Dec. 9, 2011

(65) Prior Publication Data

US 2012/0075873 A1 Mar. 29, 2012

Related U.S. Application Data

(63) Continuation of application No. 12/416,910, filed on Apr. 1, 2009, now Pat. No. 8,079,739.

(60) Provisional application No. 61/041,253, filed on Apr. 1, 2008.

(51) Int. Cl.
*F21V 19/00* (2006.01)

(52) U.S. Cl. ..... 362/382; 362/249.11; 362/249.16; 362/640; 362/647

(58) Field of Classification Search ..... 362/249.11, 362/249.16, 396, 640, 644, 647, 53, 654, 362/219

See application file for complete search history.

(56) References Cited

U.S. PATENT DOCUMENTS

| | | | | | |
|---|---|---|---|---|---|
| 4,639,841 | A * | 1/1987 | Salestrom et al. | ..... | 362/227 |
| 4,774,646 | A * | 9/1988 | L'Heureux | ..... | 362/249.01 |
| 5,067,061 | A * | 11/1991 | Prickett | ..... | 362/145 |
| 5,238,425 | A * | 8/1993 | Kliewer | ..... | 439/541 |
| 5,607,230 | A * | 3/1997 | Protz, Jr. | ..... | 362/396 |
| 5,813,751 | A * | 9/1998 | Shaffer | ..... | 362/249.08 |
| 5,823,655 | A * | 10/1998 | Brooks | ..... | 362/145 |
| 5,957,568 | A * | 9/1999 | Byers | ..... | 362/235 |
| 6,494,594 | B1 * | 12/2002 | Schroetter | ..... | 362/249.01 |
| 7,183,502 | B1 * | 2/2007 | Johnston et al. | ..... | 174/480 |

* cited by examiner

*Primary Examiner* — Ali Alavi
(74) *Attorney, Agent, or Firm* — Madson IP, P.C.

(57) ABSTRACT

A system of interlocking, rigid or semi-rigid, components which when connected provide a modular, easy-to-install, direct, decorative, lighting system.

17 Claims, 4 Drawing Sheets

INTERLOCKING SYSTEM FOR HANGING DECORATIVE LIGHTS AND FIXTURES

RELATED APPLICATION

This application is a continuation of U.S. patent application Ser. No. 12/416,910, filed Apr. 1, 2009, and entitled Interlocking System for Hanging Decorative Lights and Fixtures, which is herein incorporated in its entirety by this reference. This application also claims the benefit of U.S. Provisional Patent Application No. 61/041,253, filed Apr. 1, 2008, which is herein incorporated in its entirety by this reference.

TECHNICAL FIELD

The present disclosure relates generally to decorative lights and fixtures. More specifically, various embodiments of the present disclosure relate to methods, devices and systems for interlocking and hanging decorative lights and fixtures.

BACKGROUND

Outdoor decorative lighting of the type that is typically hung during the holidays has typically been comprised of light strings which when hung do not provide uniform lighting unless each bulb is individually secured using clips or other means. Individually securing each bulb is a time-consuming effort.

SUMMARY

The present disclosure provides a lighting system that can be quickly and easily installed to provide uniform, direct, decorative lighting without having to secure each bulb individually. Furthermore, one or more embodiments of the disclosure solve the problem of tangled wires as the wiring is embodied within rigid or semi-rigid components.

BRIEF DESCRIPTION OF THE SEVERAL VIEWS OF THE DRAWINGS

Exemplary embodiments of the disclosure will become more fully apparent from the following description and appended claims, taken in conjunction with the accompanying drawings. Understanding that these drawings depict only exemplary embodiments and are, therefore, not to be considered limiting of the disclosure's scope, the exemplary embodiments of the disclosure will be described with additional specificity and detail through use of the accompanying drawings in which:

FIG. 6 is an isometric view illustrating a permanent mounting bracket according to at least one embodiment.

FIG. 7 is an isometric view illustrating an "L"-bracket according to at least one embodiment.

FIG. 8 is an isometric view illustrating a "U"-bracket according to at least one embodiment.

FIG. 9 is an isometric view illustrating a "hinged" bracket according to at least one embodiment.

DETAILED DESCRIPTION

The illustrations presented herein are, in some instances, not actual views of any particular interlocking components, end caps, plugs, sockets, mounting brackets, connectors, or light bulbs, but are merely idealized representations which are employed to describe the present devices and methods. Additionally, elements common between figures may retain the same numerical reference designation.

Figure 1:
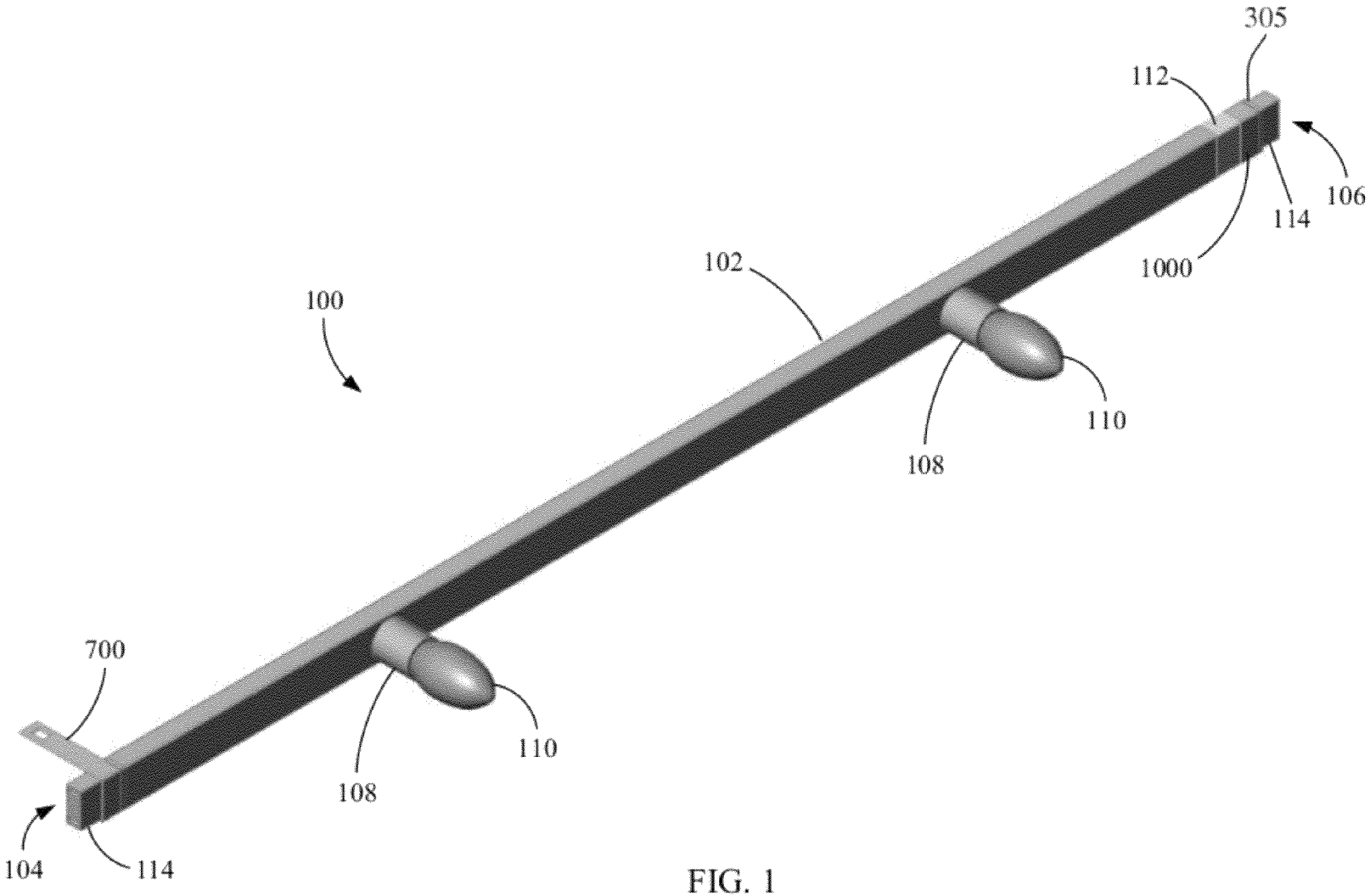
FIG. 1 is an isometric view illustrating an example of an embodiment of a section of a lighting or fixture assembly including various features.

Various embodiments of the present disclosure relate to methods, devices and systems for hanging decorative lights and fixtures. FIG. 1 is a three-dimensional or isometric view illustrating an example of an interlocking section 100 of a decorative lighting or fixture system. The interlocking section 100 includes an elongated housing 102 comprising a first longitudinal end 104 and a second longitudinal end 106. The elongated housing 102, which may also be referred to as a rail, channel and/or frame, can comprise a rigid or semi-rigid construction. The elongated housing 102 can comprise any of a number of various lengths.

The elongated housing 102 further includes an internal cavity (not shown) through which an electrical conduit (not shown) is run. One or more apertures can also be included for receiving sockets 108 adapted to receive a decorative light bulb 110. The sockets 108 can comprise any conventional socket adapted to receive a conventional light bulb and to be coupled to an electrical source, such as the electrical conduit running through the internal cavity of the elongated housing 102. By way of example and not limitation, the sockets 108 can comprise C7, C9 or other conventional sockets coupled to the internal electrical conduit.

A male plug 112 having male prongs (e.g., a plurality of male conductors) can be coupled to the first or second longitudinal end 104, 106. In the illustrated example, the male plug 112 is coupled to the second longitudinal end 106. In addition, a female plug 114 (e.g., female receptacles corresponding to, and adapted to receive the male prongs) is coupled to the other of the first or second longitudinal end 104, 106 of the elongated housing 102. In the illustrated example, a female plug 114 is coupled to the first longitudinal end 104, and another female plug 114 is shown coupled to the male plug 112 with a spacer 1000 disposed between the two at the second longitudinal end 106. Both the male and female plugs 112, 114 at each longitudinal end 104, 106 are electrically coupled to the electrical conduit running through the internal cavity of the elongated housing 102.

Figure 2:
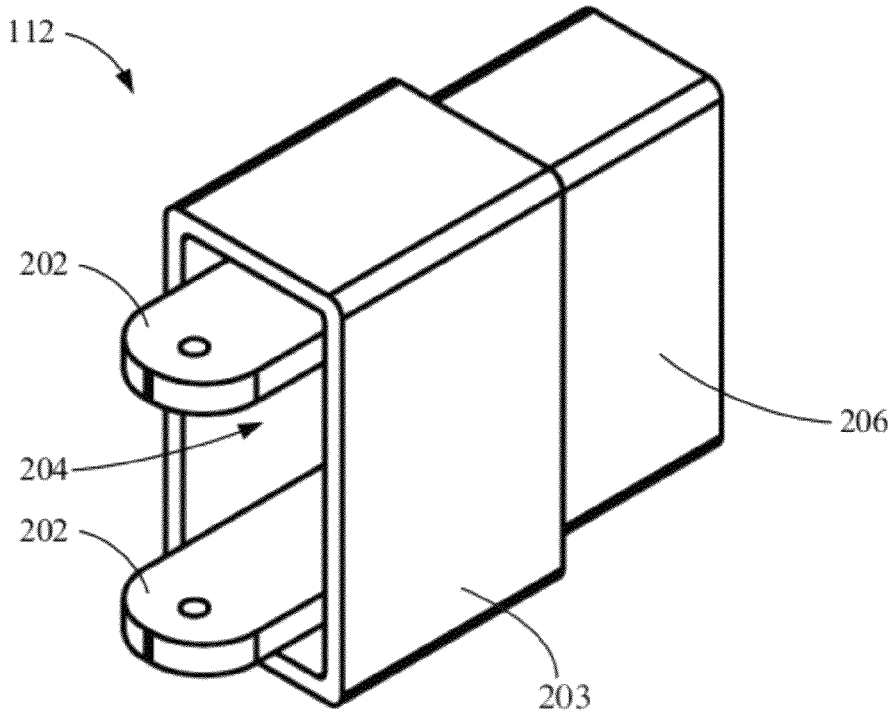
FIG. 2 is an isometric view illustrating a male plug end according to at least one embodiment.

Turning to FIG. 2, an isometric view is shown illustrating a male plug 112 according to at least one embodiment. The male plug 112 comprises a plurality of male prongs (or male conductors) 202 positioned in a cavity 204 surrounded and defined by shroud 203. The male plug 112 also includes a housing attachment end 206 adapted to be received in the elongated housing 102, as depicted in FIG. 1.

Figure 3:
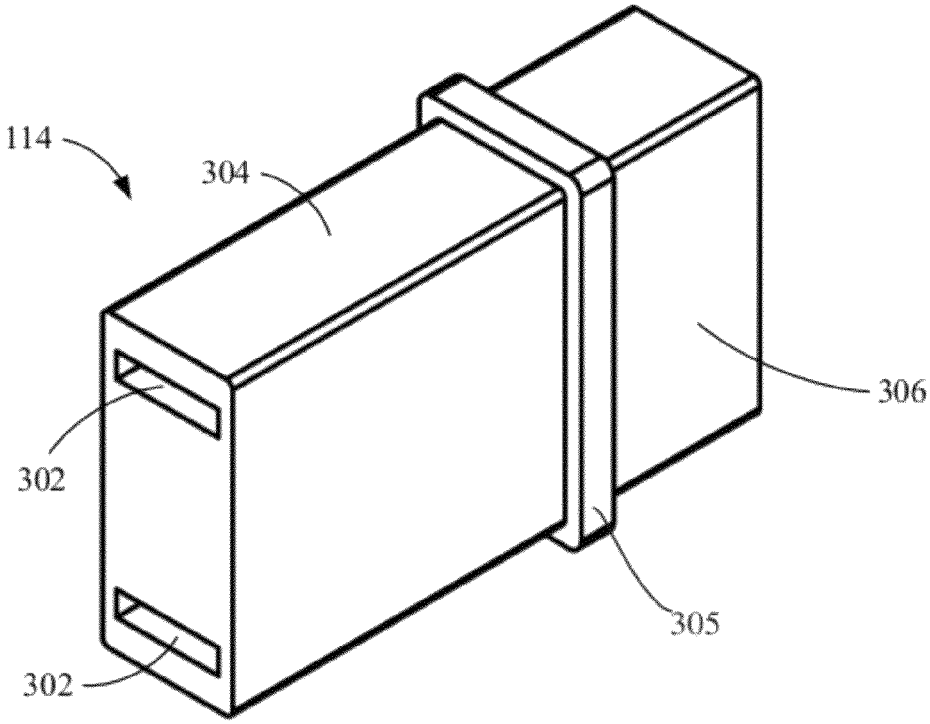
FIG. 3 is an isometric view illustrating a female plug end according to at least one embodiment.

Turning to FIG. 3, an isometric view is shown illustrating a female plug 114 according to at least one embodiment. The female plug 114 includes female receptacles 302 corresponding to the male prongs 202 of the male plug 112 (see FIG. 2) for receiving therein and completing an electrical circuit, as is common among male and female plugs. The female receptacles 302 are positioned in a projection 304 adapted to be received into the cavity 204 of the male plug 112 (see FIG. 2), as illustrated at the second longitudinal end 106 of the elongated housing 102 in FIG. 1. The female plug 114 also includes a housing attachment end 306 adapted to be received in the elongated housing 102, as depicted in FIG. 1. In some embodiments, a collar 305 is disposed about the female plug 114 between projection 304 and housing attachment end 306, as depicted in FIG. 3.

The male and female plugs 112, 114 can facilitate electrically coupling multiple interlocking sections 100 together in such a manner as to enable the electrical conduit to continue from one section to the next to form a decorative lighting or fixture system consisting of several interlocking sections 100. Although the example shown illustrates only a straight interlocking sections 100, in some implementations, an interlocking section 100 can be shaped to provide illuminated or non-illuminated letters or words, illuminated or non-illuminated designs (such as stars, birthday cakes, etc.), motorized gadgets, etc. such that each of these sections can be plugged into the system between any two other interlocking sections 100 (or between an interlocking section 100 and an end cap 400 described below).

Figure 4:
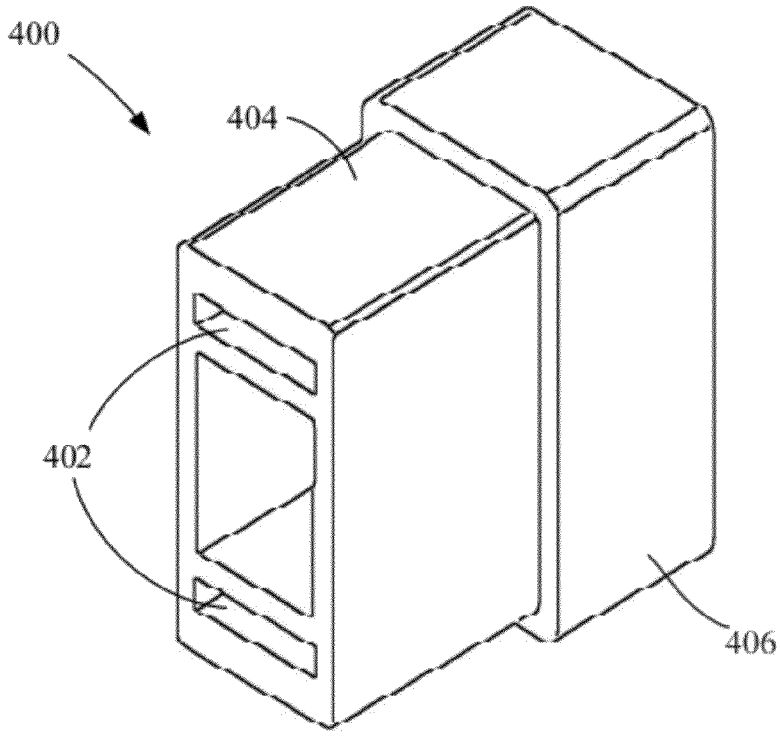
FIG. 4 is an isometric view illustrating a female end cap according to at least one embodiment.

Turning to FIG. 4, an isometric view of an end cap 400 is illustrated according to at least one embodiment. The end cap 400 is adapted to cover or "cap" a plug coupled to the elongated housing to end a string of a plurality of interlocking sections 100. The end cap 400 shown is adapted to "cap" a male plug 112 and accordingly includes female receptacles 402 adapted to receive the male prongs 202 of the male plug 112 (see FIG. 2). The end cap 400 also includes a projection 404 adapted to be received into the cavity 204 of the male plug 112 (see FIG. 2) and a shoulder 406. In this manner, the end cap 400 covers the male plug 112 and ends the electrical circuit.

Figure 5:
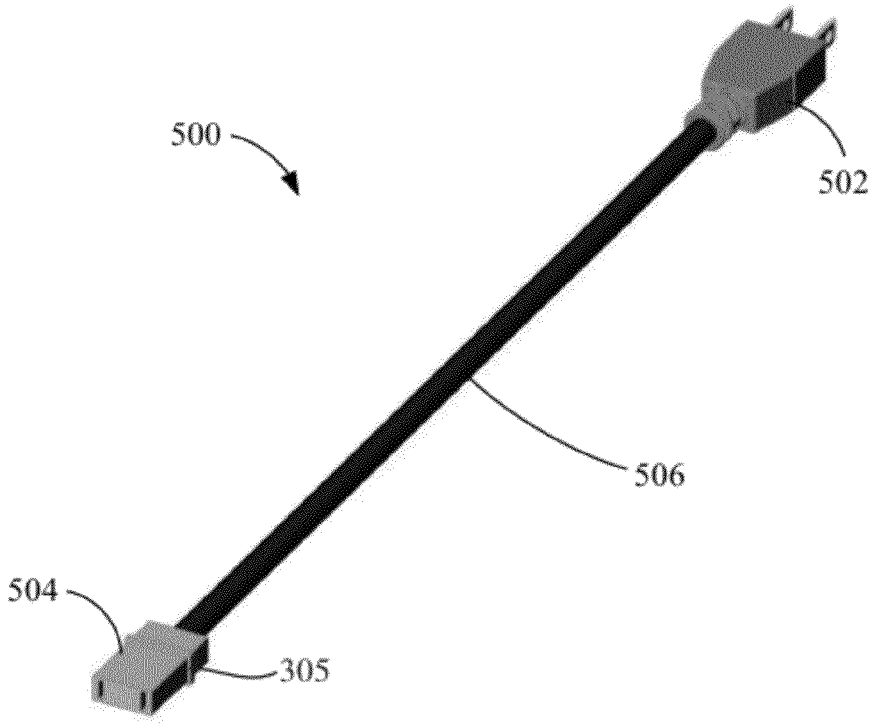
FIG. 5 is an isometric view of a flexible connector according to at least one embodiment.

In some instances an interlocking section 100 of a decorative lighting fixture assembly (see, e.g., FIG. 1) may be coupled to another interlocking section 100 of the decorative lighting fixture assembly at a corner or at one of various angles. FIG. 5 illustrates a flexible connector adapted to facilitate such connections between interlocking sections 100 about corners and/or various angles. As illustrated, the flexible connector 500 includes a male plug connector 502 at one longitudinal end, and a female plug connector 504 at an opposing longitudinal end. The male plug connector 502 is electrically coupled to the female plug connector 504 with a flexible cord 506 extending between the two. The female plug connector 504 can be configured similar to the female plug 114 described above with reference to FIGS. 1 and 3. The male plug connector 502 can be configured similar to the male plug 112 described above with reference to FIGS. 1 and 2, or the male plug connector 502 can be adapted to also plug into a standard electrical outlet for providing power to one end of the assembly.

The various interlocking sections 100 of a decorative lighting or fixture assembly can be hung or otherwise attached to various surfaces with one or more mechanical or magnetic mounting brackets. Such mounting brackets can be attached to each section 100 for hanging each section 100 on various surfaces, such as eaves, rain gutters, walls, etc. FIGS. 6-9 illustrate various examples of mounting brackets that may be used in various implementations.

Figure 6:
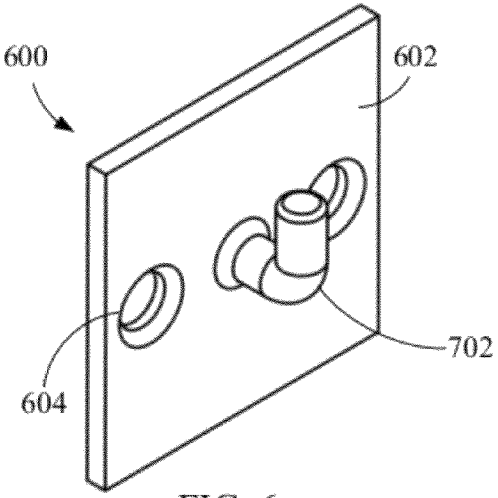

Referring to FIG. 6, a permanent mounting bracket 600 is shown according to at least one embodiment. The permanent mounting bracket 600 includes a plate 602 with one or more apertures 604 therein, and a hook-shaped protrusion 606 extending from one side of the plate 602.

Figure 7:
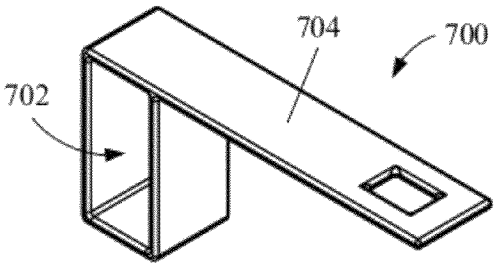
FIGS. 6-9 illustrate various examples of mounting brackets adapted to couple a section of a lighting fixture to one or more different surfaces.

FIG. 7 shows an example of a mounting bracket embodied as an "L"-bracket 700 according to at least one implementation. The "L"-bracket 700 is configured with a channel 702 sized and configured to fit over a portion of the projection 304 of the female plug 114 (see FIG. 3). Referring briefly to FIG. 1, the section 100 of the decorative lighting or fixture assembly illustrates an "L"-bracket 700 coupled to the female plug 114 at the first longitudinal end 104. As illustrated, the channel 702 of the "L"-bracket 700 is disposed around a portion of the projection 304 (see FIG. 3) of the female plug 114. Returning to FIG. 7, the "L"-bracket further includes an attachment arm 704 extending from the channel 702 and adapted to be coupled to a flat surface. By way of example and not limitation, the "L"-bracket 700 may be employed for mounting the section 100 to a flat surface, such as a front surface of a home where no rain gutter is present.

Figure 8:
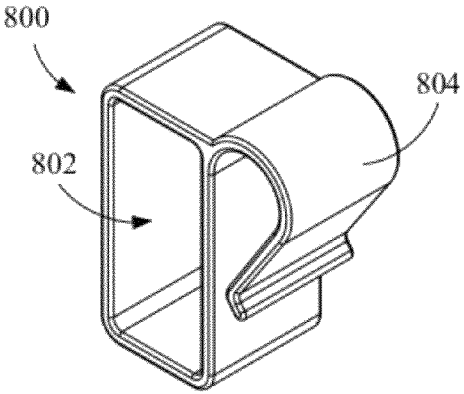

FIG. 8 shows an example of a mounting bracket embodied as a "U"-bracket 800, according to at least one implementation. The "U"-bracket 800 is configured with a channel 802 that is similar to the channel 702 of FIG. 7 described above. A "U"-shaped clip 804 is also included. By way of example and not limitation, the "U"-bracket 800, with its clip 804, may be employed for mounting to a rain gutter or other surfaces.

Figure 9:
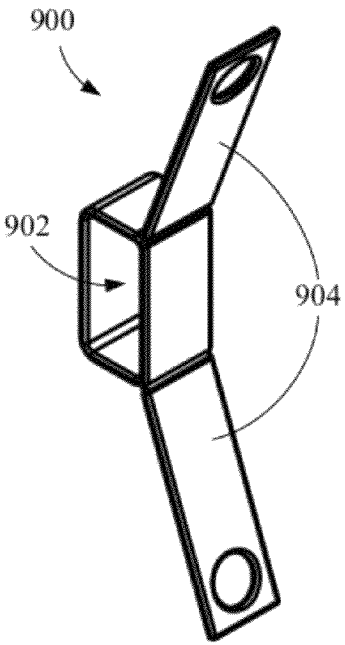

FIG. 9 is an isometric view of another example of a mounting bracket, where the mounting bracket is embodied as a "hinged" bracket 900. The "hinged" bracket 900 also includes a channel 902 similar to the channels 702 and 802 from FIGS. 7 and 8. The "hinged" bracket 900 also includes a couple of attachment arms 904 hingedly coupled to the channel 902. The "hinged" bracket 900 may be employed for installations on rigid surfaces.

Figure 10:
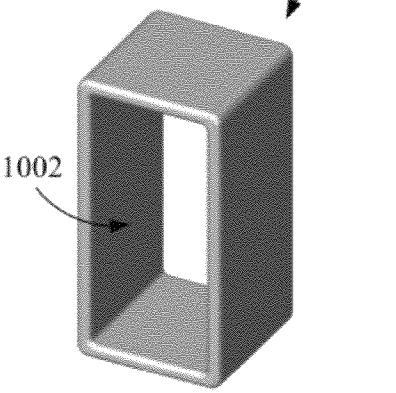
FIG. 10 is an isometric view illustrating a spacer according to at least one embodiment.

As shown, various mounting brackets may be used, and at least some of which are configured to be coupled to a female plug, such as the female plug 114 of FIGS. 1 and 3. However, in some implementations, no bracket may be employed. In such implementations, a spacer 1000 may be employed between a male plug 112 and a female plug 114 when sections are coupled together, as shown in FIG. 1 at the second longitudinal end 106. With reference to FIG. 10, illustrating an isometric view of a spacer 1000 according to at least one embodiment, the spacer 1000 comprises a channel 1002 that is configured similar to the channels 702, 802 and 902 of the various mounting brackets in FIGS. 7-9.

The various embodiments described herein above provide for decorative lighting or fixture systems that can be quickly and easily installed to provide uniform, direct, decorative lighting without having to secure each bulb individually. Furthermore, one or more embodiments described above results in decorative lighting systems that are not subject to conventional problems relating to tangling wires, as the wiring is at least substantially enclosed within rigid or semi-rigid interlocking sections.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A section of an interlocking decorative lighting system, comprising:

an elongated housing comprising a first longitudinal end and an opposing second longitudinal end;

a male plug coupled to one of the first or second longitudinal end;

a female plug coupled to the other of the first or second longitudinal end opposite from the male plug;

at least one decorative light socket coupled to the elongated housing;

an electrical conduit enclosed within the housing and extending from the first longitudinal end to the second longitudinal end thereof, wherein the electrical conduit is electrically coupled to the male plug, the female plug and the at least one decorative light socket; and a mounting bracket coupled to at least one of the male plug, the female plug, or the elongated housing.

2. The section of interlocking decorative lighting assembly of claim 1, wherein the mounting bracket comprises one of a permanent mounting bracket, an "L"-bracket, a "U"-bracket or a "hinged" bracket.

3. The section of the interlocking decorative lighting assembly of claim 1, wherein the male plug comprises:

a shroud that surrounds a cavity;

a plurality of conductive male prongs extending in the cavity; and a housing attachment end adapted to be received in the elongated housing.

4. The section of the interlocking decorative lighting assembly of claim 3, wherein the female plug comprises:

a projection sized and shaped to be disposed into a corresponding cavity in the male plug;

a plurality of female receptacles extending into the projection;

a housing attachment end adapted to be received in the elongated housing; and a collar disposed about the female plug between the projection and the housing attachment end.

5. The section of the interlocking decorative lighting assembly of claim 4 wherein the mounting bracket is disposed between the shroud and the collar.

6. The section of the interlocking decorative lighting assembly of claim 1, further comprising an end cap coupled to the male plug, the end cap having female receptacles in a female projection and a shoulder.

7. The section of the interlocking decorative lighting assembly of claim 6 wherein the mounting bracket is disposed between the elongated housing and the shoulder.

8. The section of the interlocking decorative lighting assembly of claim 1, further comprising a flexible connector coupled to at least one of the male plug or the female plug, the flexible connector comprising a male plug connector, a female plug connector, and a flexible cord extending between and electrically coupling the male plug connector to the female plug connector.

9. A modular lighting system, comprising:

a plurality of interlocking sections, at least some of the plurality of interlocking sections comprising:

an elongated housing comprising at least one light socket coupled thereto;

a male plug coupled to one of a first longitudinal end or a second longitudinal end of the elongated housing;

a female plug coupled to the other of the first or second longitudinal end opposite from the male plug;

an electrical conduit enclosed within the housing and extending from the first longitudinal end to the second longitudinal end thereof, wherein the electrical conduit is electrically coupled to the male plug, the female plug and the at least one light socket, wherein the male plug of at least one interlocking section of the plurality is coupled to the female plug of another interlocking section of the plurality; and a mounting bracket coupled to at least one of the male plug, the female plug, or the elongated housing.

10. The modular lighting system of claim 9, wherein at least a portion of the mounting bracket is magnetic.

11. The modular lighting system of claim 9, wherein at least some of the plurality of interlocking sections are coupled together with a flexible connector comprising:

a female plug connector coupled with the male plug of a first interlocking section;

a male plug connector coupled with the female plug of a second interlocking section; and a flexible cord extending between and electrically coupling the male plug connector to the female plug connector.

12. The modular lighting system of claim 9, wherein at least one of the interlocking sections is implemented as one of a substantially straight section, illuminated or non-illuminated letters or words, illuminated or non-illuminated designs or a motorized gadget.

13. The modular lighting system of claim 9, wherein an interlocking section coupled to only one other interlocking section comprises an end cap coupled to the end opposite the end coupled to the other interlocking section.

14. The modular lighting system of claim 9, wherein at least some of the interlocking sections comprise a light bulb coupled to the at least one light socket.

15. The modular lighting system of claim 9, wherein the male plug of at least some interlocking sections of the plurality of interlocking sections comprises:

a shroud surrounding a cavity, the cavity sized and shaped to receive a portion of the female plug therein;

a plurality of conductive male prongs extending into the cavity; and a housing attachment end opposite from the cavity and adapted to be disposed in the elongated housing.

16. The modular lighting system of claim 15, wherein the female plug of at least some interlocking sections of the plurality of interlocking sections comprises:

a plurality of female receptacles extending into a projection, the projection being sized and shaped to be disposed into the cavity in the male plug;

a housing attachment end opposite from the projection and adapted to be disposed in the elongated housing; and a collar disposed about the female plug between the projection and the housing attachment end.

17. The modular lighting system of claim 9, wherein the mounting bracket comprises one of a permanent mounting bracket, an "L"-bracket, a "U"-bracket or a "hinged" bracket.

* * * * *